US008337322B2

(12) United States Patent
Harper

(10) Patent No.: US 8,337,322 B2
(45) Date of Patent: Dec. 25, 2012

(54) DEVICE FOR GAME

(76) Inventor: Paul Ivor Harper, Walmer (GB)

( * ) Notice: Subject to any disclaimer, the term of this patent is extended or adjusted under 35 U.S.C. 154(b) by 309 days.

(21) Appl. No.: 12/611,585

(22) Filed: Nov. 3, 2009

(65) Prior Publication Data

US 2010/0160063 A1 Jun. 24, 2010

(30) Foreign Application Priority Data

Nov. 4, 2008 (GB) ..... 0820159

(51) Int. Cl.
*A63B 47/02* (2006.01)

(52) U.S. Cl. ..... 473/286

(58) Field of Classification Search ..... 473/282, 473/285, 286; D21/793–796
See application file for complete search history.

(56) References Cited

U.S. PATENT DOCUMENTS

| | | | | |
|---|---|---|---|---|
| 2,801,875 | A * | 8/1957 | McEvoy | 294/19.2 |
| 3,149,808 | A * | 9/1964 | Weckesser | 248/74.3 |
| 5,573,241 | A * | 11/1996 | Anderson | 473/282 |
| 7,152,832 | B2 * | 12/2006 | Wochnick | 248/74.3 |
| 7,789,765 | B2 * | 9/2010 | Marini | 473/226 |
| 7,841,951 | B1 * | 11/2010 | Schiltz | 473/282 |

* cited by examiner

*Primary Examiner* — Stephen L. Blau
(74) *Attorney, Agent, or Firm* — Ditthavong Mori & Steiner, P.C.

(57) ABSTRACT

A device for a game, the device attachable to a playing means and including a substantially annular gripping portion surrounding an inner member, said gripping portion including a first and a second end, the arrangement being such that with said first and second ends urged towards one another the gripping portion squeezes the inner member to more securely grip the playing means.

15 Claims, 19 Drawing Sheets

DEVICE FOR GAME

CROSS-REFERENCE TO RELATED APPLICATION

The present application claims priority to United Kingdom Application No. 0820159.2, filed on Nov. 4, 2008, the entire contents of which are herein incorporated by reference.

BACKGROUND OF THE INVENTION

1. Field of the Invention

The present application relates to an accessory for playing a game, in particular for playing golf.

2. Discussion of the Background

Golf is a popular game and has enthusiasts across the age range. When playing golf a golfer may send the golf ball high into the air and onto the green, the golf ball thereby potentially causing an indentation on the surface of the green bruising the grass or otherwise damaging the green surface. In addition, it is often necessary during play for a player to bend down towards the ground, for example to retrieve a golf ball or to seek to repair damage to the green or some such, and this can be awkward for the less agile such as the elderly, or those with arthritis or other medical conditions.

It would be helpful, and enhance the enjoyment of the game, if a device was available to assist in these matters, such that a player did not need to bend and reach down to the ground. Some devices are available and often include means to attach the device to the handle end of a golf club, such as a putter, however difficulties remain in the attachment mechanism.

SUMMARY OF THE INVENTION

The present invention provides, according to a first aspect, a device for a game, the device attachable to a playing means, for example a golf club such as a putter. The attachment means for the device includes a substantially annular gripping portion surrounding an inner feature which, when squeezed by the gripping portion, tightens the grip on the playing means. The gripping portion is held in the annular configuration by co-operative engagement means on either end of the gripping portion which, when squeezed against a resilient force keeping the ends apart, engage to hold the ends together.

BRIEF DESCRIPTION OF THE DRAWINGS

A preferred embodiment of the present invention will now be described by way of example only and with reference to the accompanying drawings in which.

DETAILED DESCRIPTION OF EXEMPLARY EMBODIMENTS OF THE INVENTION

Figure 1:
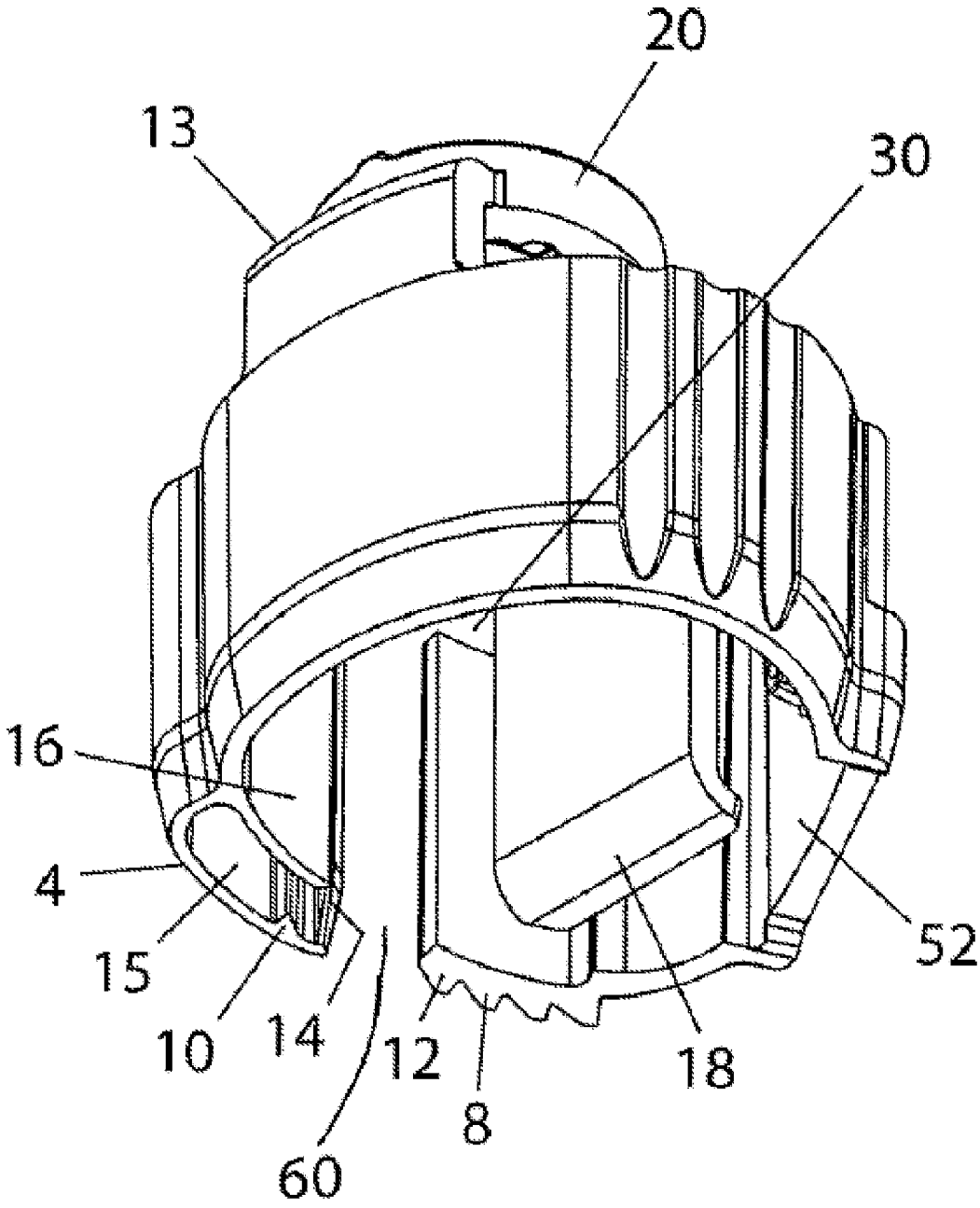
FIGS. 1(*a*) and (*b*) show perspective views of the device according to a first embodiment of the present invention, FIGS. 1(*c*)-(*e*) show perspective views of the device according to a second embodiment of the present invention, FIG. 2 (*a*) shows a key portion of an accessory for use with the device, FIGS. 2(*b*) to (*g*) show views of locking mechanisms of the invention, FIG. 3(*a*) shows the device in accordance with the first embodiment mounted on a golf club, such as a putter, FIG. 3(*b*) shows the device in accordance with the second embodiment mounted on a golf club, such as a putter.
Figure 1:
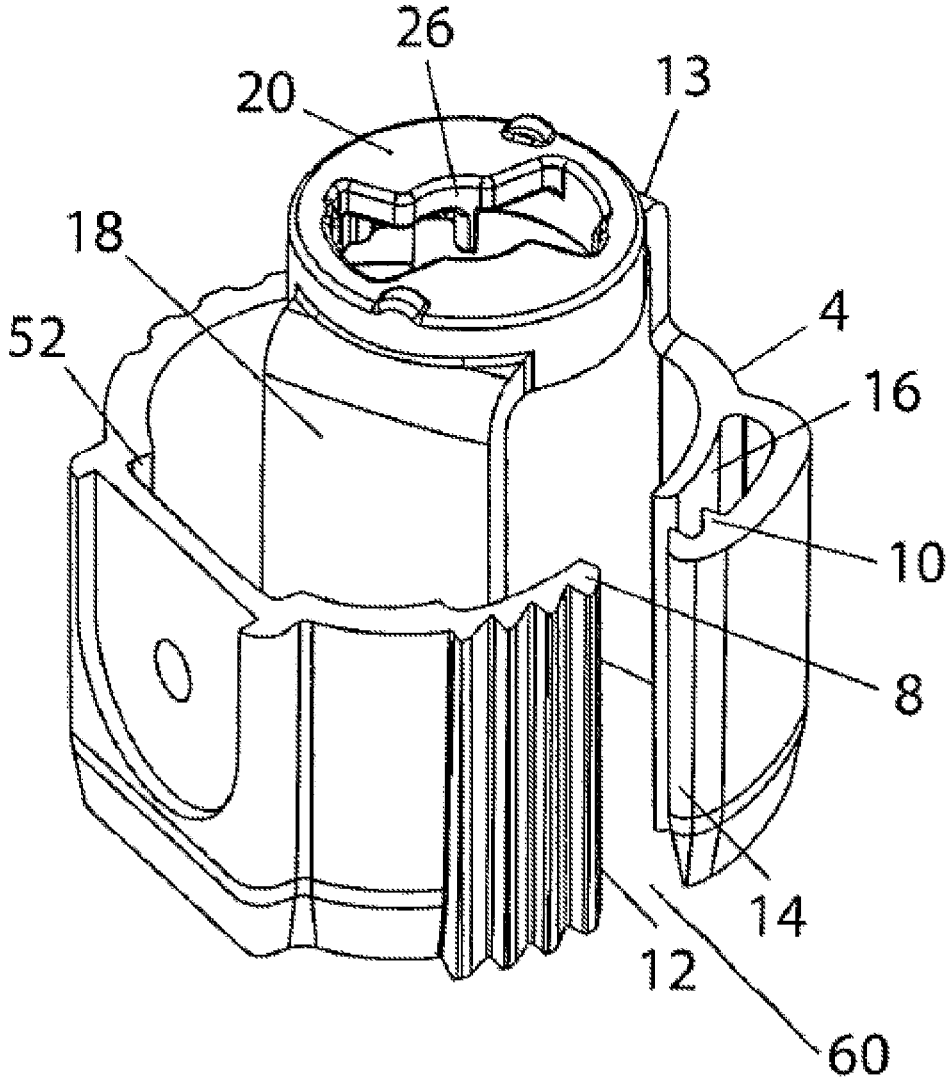
Figure 1:
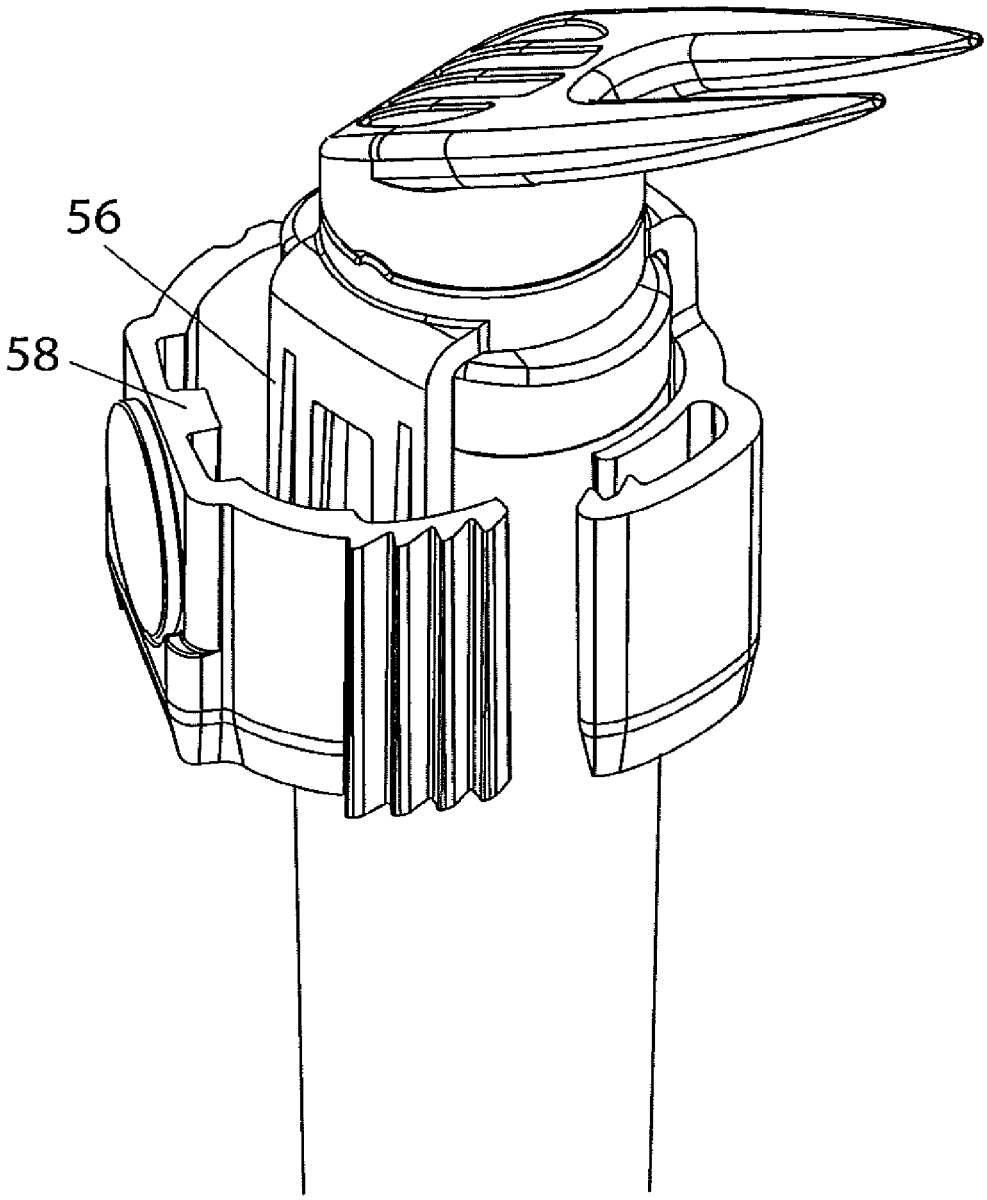
Figure 1:
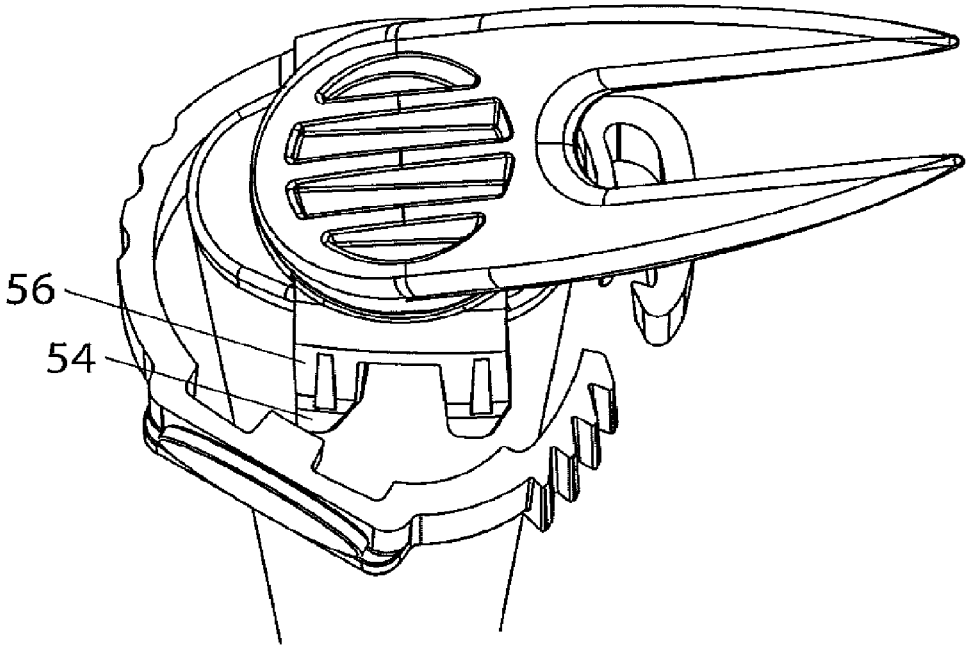
Figure 1:
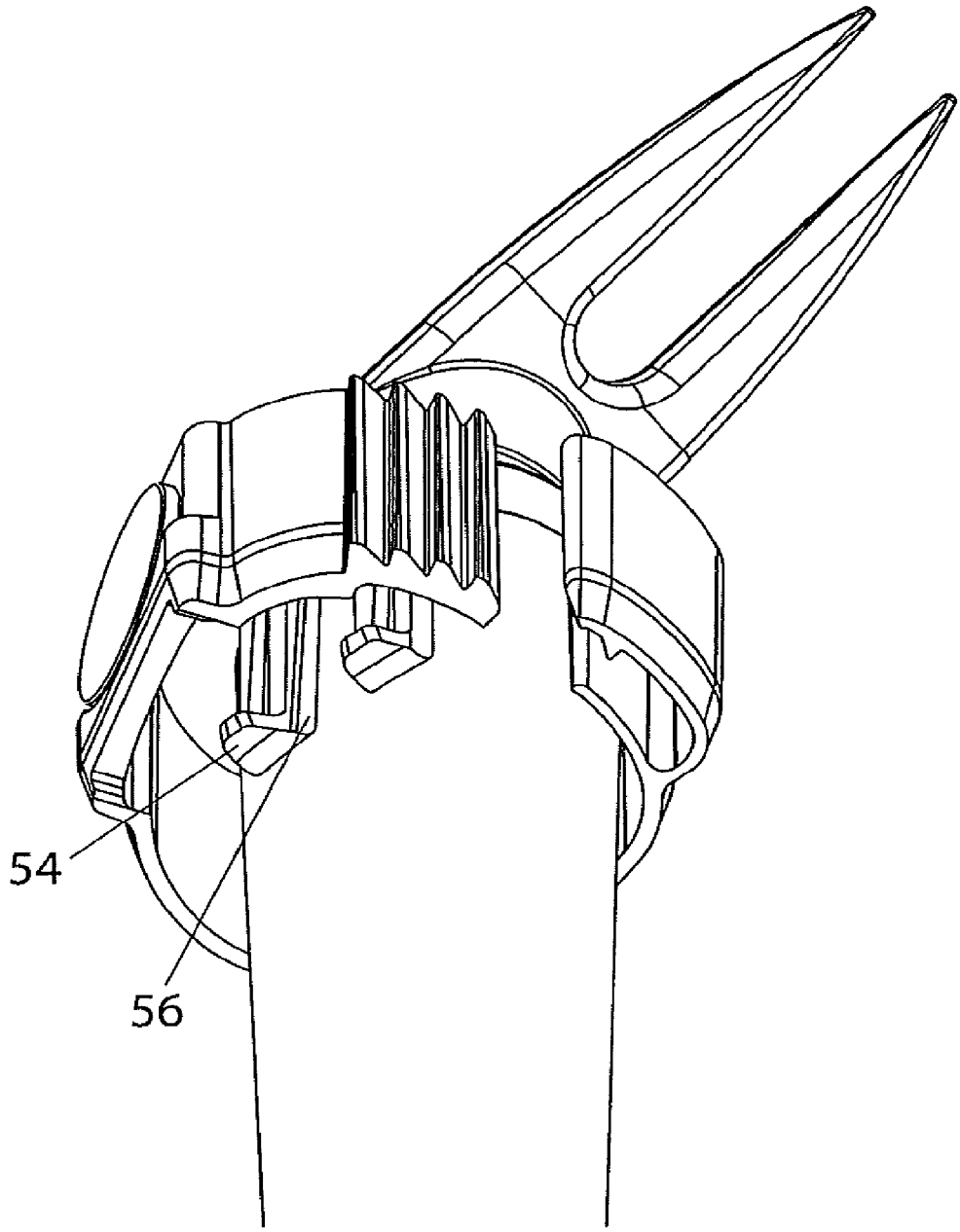

As can be seen from FIGS. 1 (*a*), 1 (*b*) and 2, the device comprises a curved wall, 4 arranged in approximately a circular arrangement and including co-operative engagement means 8, 10 at each end 12, 14. At rest the wall does not form a complete circle but remains slightly open, with a resilient force maintaining the resting arrangement. With the ends 12, 14 urged towards each other the co-operative engagement means 8, 10 may engage one with another to form a complete ring enclosing a cavity 60, held in position against the resilient force by the engagement means, such as fingers, 8 on the first end 12 of the wall 4 engaging with the engagement means, such as fingers, 10 on the second end 14 of the wall 4. The device further comprises a curved inner wall 16 formed on an interior side of the curved wall 4 near an end 14, and a top portion 20 attached to the curved wall at an attachment point 13, and extending over the top of the cavity 60. A first end of the top portion 20 is attached to the curved wall 4 at attachment point 13 and a second end of the top portion 20 includes a member 18 resiliently attached to, and extending away from, the top portion 20 into the cavity.

With first end 12 inserted into channel 15 formed by wall 4 and inner wall 16, inner wall 16 may be resiliently displaced from its rest position inwardly into the cavity 60 and acts to more securely fix the device on the handle.

FIG. 1(*a*) further shows an indentation 52 on the internal surface of curved wall 4 provided to receive member 18 when ends 12, 14 are urged towards each other to form the closed ring. With the device in a closed orientation the member 18 is received into indentation 52 such that, with the device mounted on a golf club handle, such as a putter handle, the member 18 may be resiliently displaced from its rest position and acts to more securely fix the device on the handle.

In a first embodiment member 18 comprises a single planar bar with, at an end remote from top portion 20, a rim 54 which extends in a substantially perpendicular direction away from the plane of the member 18. Rim 54 engages with the base of the wall 4 of the indentation distal top portion 20 when the closed ring is locked into position by engagement of engagement means 8, 10.

In a further embodiment FIGS. 1(*c*) and (*d*) show member 18 divided into two legs 56. In this embodiment the indentation 52 includes a peg 58 which extends into the cavity 60 and which is smaller than the gap between the legs 56 and fits between them when the ring is closed. The bar is split into two legs to more securely fix the device to the handle. As with the single bar, each leg 56 includes a rim 54 which engages with the base of the wall 4 of the indentation remote from top portion 20 when the closed ring is locked into position by engagement of engagement means 8, 10.

FIG. 1(*b*) shows a perspective view of the top portion 20 of the device including a shaped opening 26 which forms part of a locking mechanism 28. The device may be used with accessories which include a key portion 66 shaped to fit the opening 26.

Figure 2:
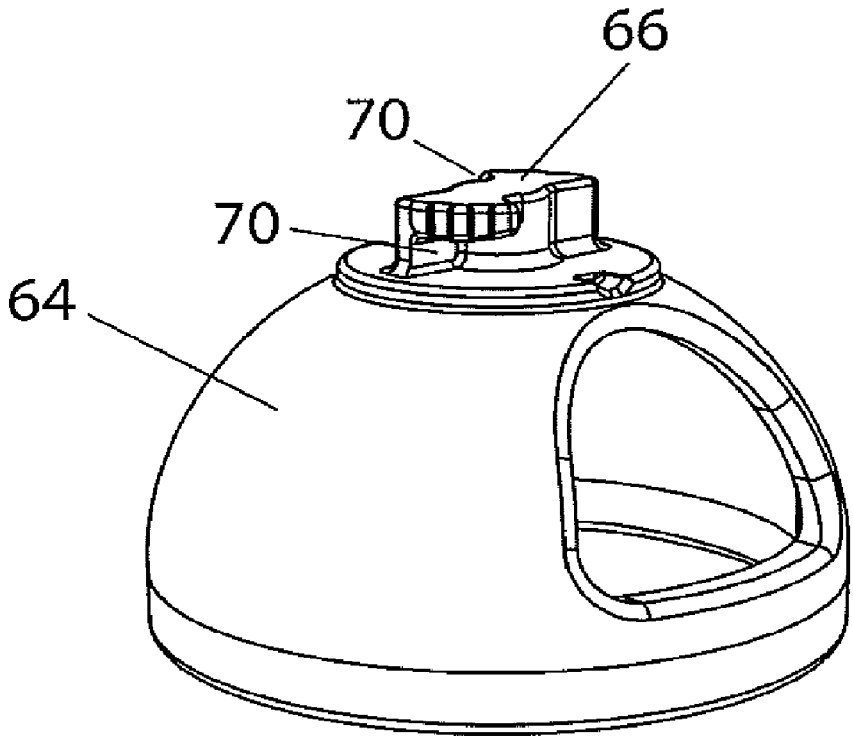
Figure 2:
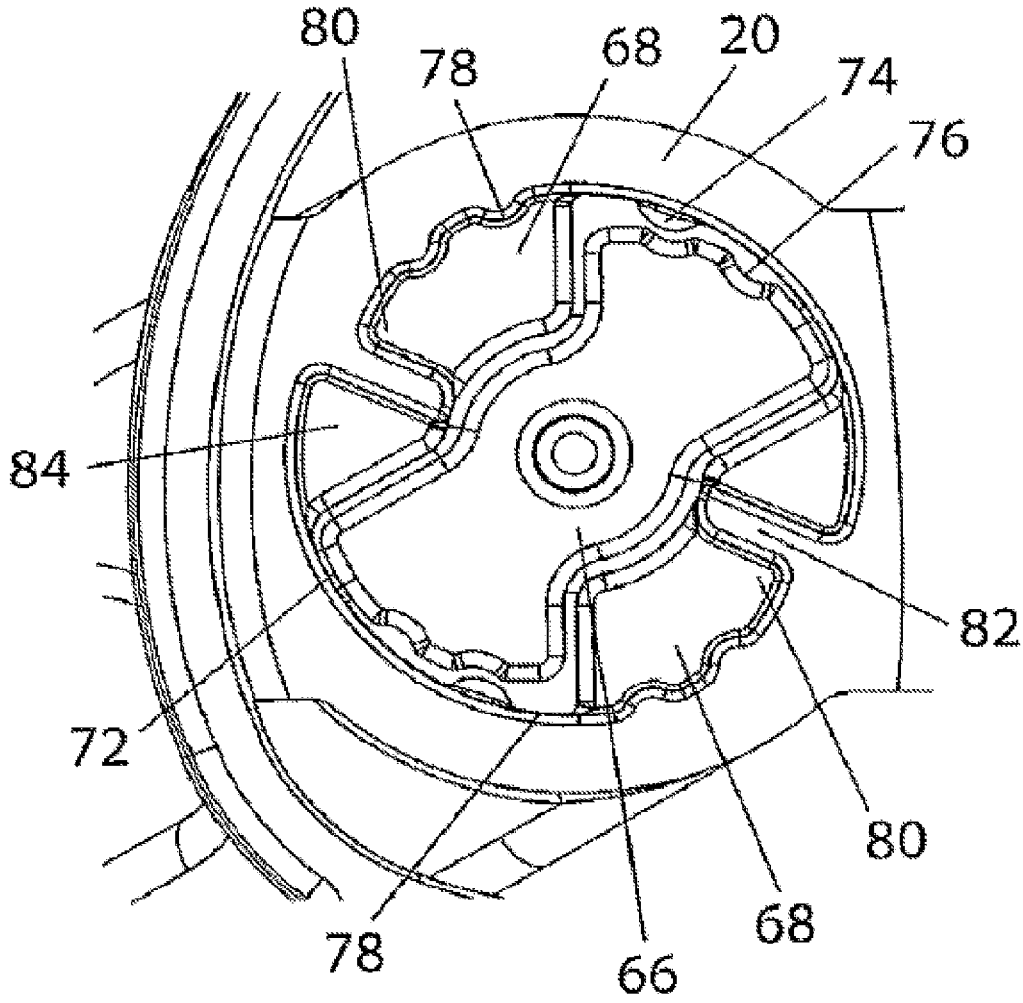
Figure 2:
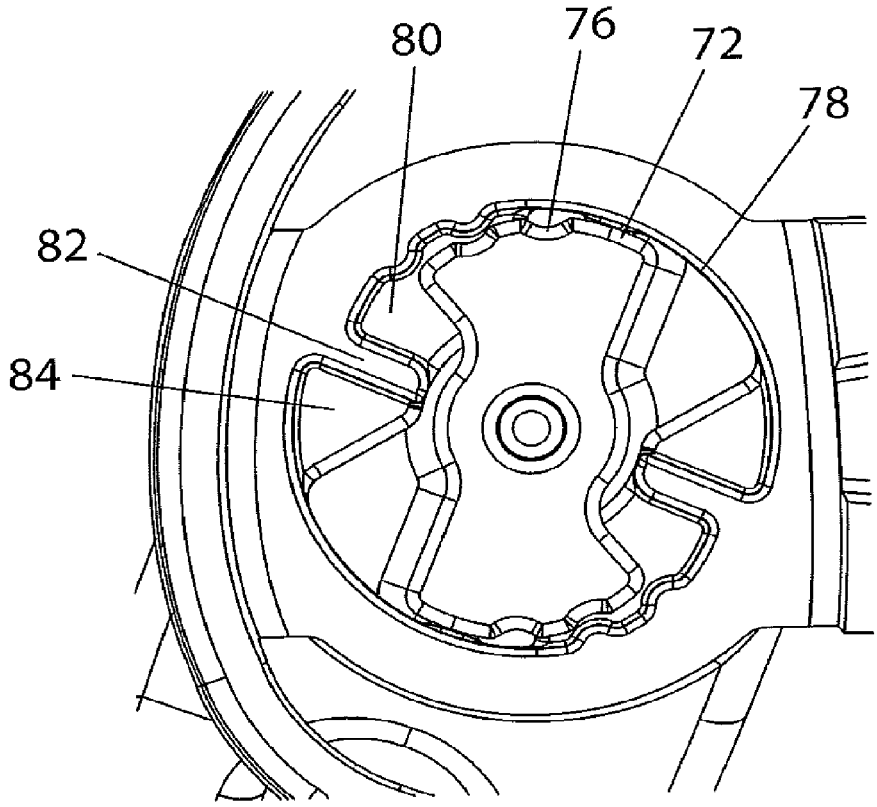
Figure 2:
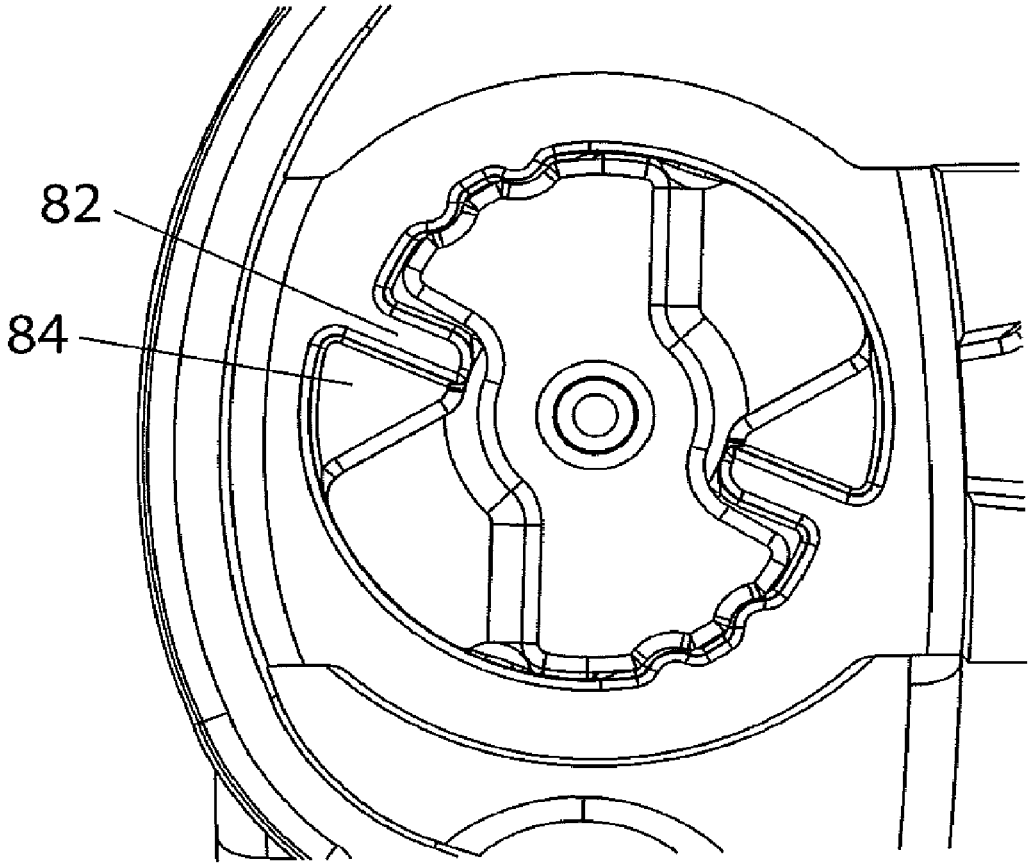
Figure 2:
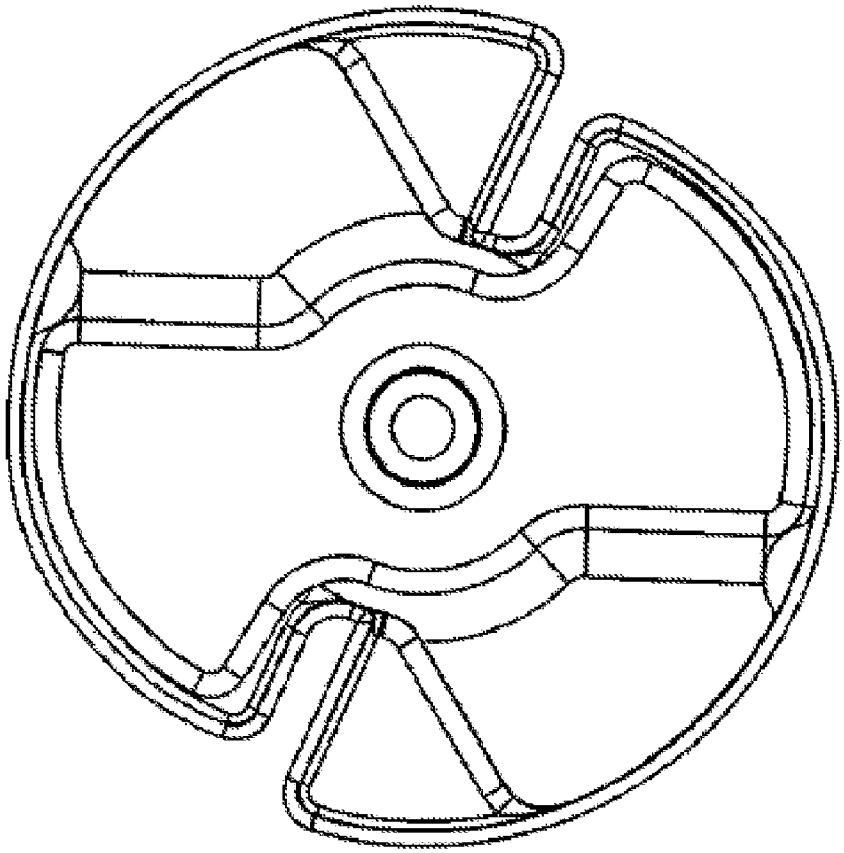
Figure 2:
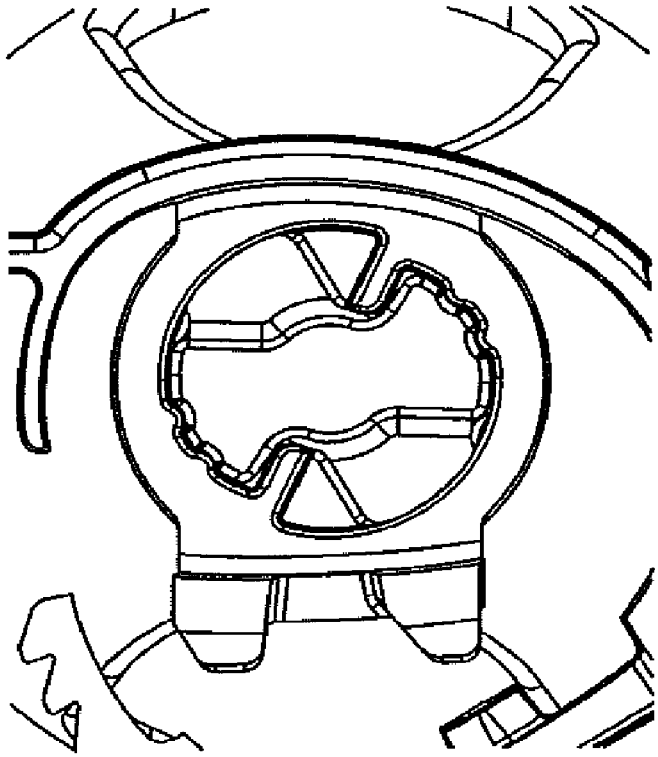
Figure 2:
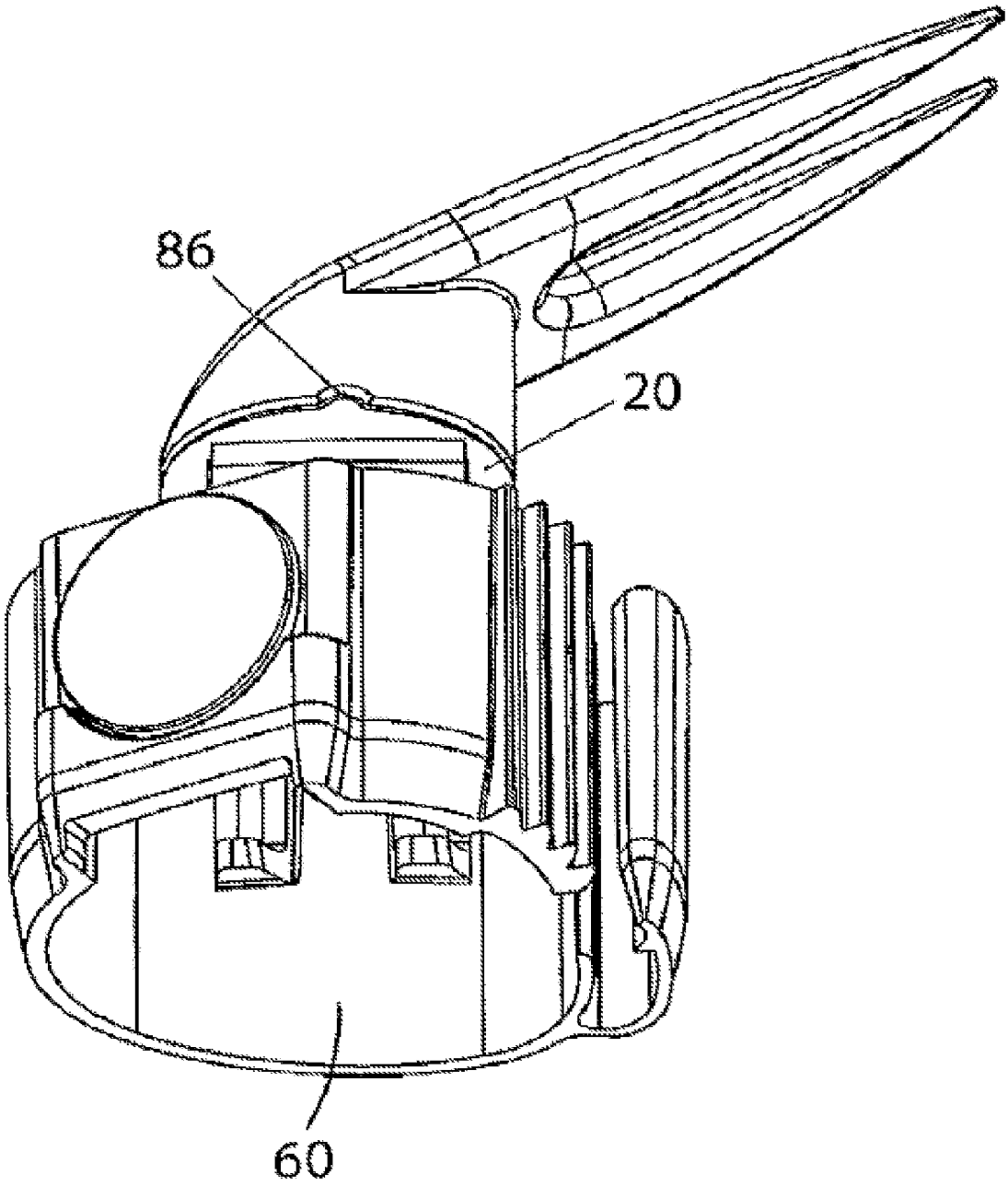

FIGS. 2(*a*) to (*f*) show the locking mechanism for attachment of accessories to the device. In particular, FIG. 2(*a*) shows a perspective view of a key portion 66 on an accessory 64, the key portion shaped to fit into and engage with opening 26, including undercuts 70. FIG. 2(*b*) shows the top portion 20 of the device from below with the key portion 66 of accessory 30 positioned in opening 26 in an unlocked orientation. FIG. 2(*b*) further shows locking portions 68 and ridges on the top portion 20 and hollows 76 on key portion 66. Opening 26 on top portion 20 includes an outer circular rim 78, the opening limited to a butterfly shape by the presence of inwardly extending radial shelves 80 on the rim 78. Each radially extending shelf 80 includes a reinforcing rib 82, a wing 84 on one side of the rib 82 and a locking portion 68 on the other. Within the butterfly-shaped opening the rim also includes ridges 74. As can be seen from FIG. 2(*e*), with the key 66 in a locked orientation in opening 26, the key is retained in place by the presence of ridges 74 and ribs 82.

Further features hold the key in position, for example, undercuts 70 on key portion 66 are a decreasing spiral shape so that the key meets no resistance when first turned in the opening to move undercut 70 over shelves 80, however as the key is turned the undercut provides a reduced opening, such that as the key is rotated into its locked position the fit becomes increasingly tight. In addition, the outer edge of the butterfly wing of the key forms a scalloped shape, as seen in FIGS. 2(*b*) to (*d*), the resulting hollows 76 of the scallop fitting over the ridges 74 such that the ridges can be more intrusive without preventing the lock mechanism to be engaged. Rim 78, by shelf 80 also includes a scalloped edge to accommodate the scalloped edge of key 66.

FIG. 2(*c*) shows the top portion 20 of the device from below with the key portion 66 of accessory 30 positioned in opening 26 in an orientation intermediate an unlocked and locked position. Locking portions 68 on top portion 20 have entered into undercuts 70 on accessory 30.

FIG. 2(*d*) shows the top portion of the device from below with key portion 66 of accessory 30 positioned in opening 26 in a locked orientation. Locking portions 68 have entered into and are fully engaged with undercuts 70.

FIG. 2(*e*) shows one embodiment of the device with a key portion 66 in a locked orientation in opening 26. As can be seen key portion 66 is butterfly shaped with a smooth external edge 72 and opening 26.

FIG. 2(*f*) shows a further embodiment of the device with key 66 engaged in a locked position in opening 26, with co-operative scalloped edges of key and rim engaged together, undercuts 70 engaged with shelves 80, and with the key held in place between on one side, rib 80 and on the other side, ridges 74.

FIG. 2(*g*) shows a device with an accessory attached, with the key of the accessory positioned in the lock in a locked orientation, and provides a perspective view of a further mechanism 86 to retain the accessory in position. As can be seen the further mechanism comprises a male feature on an outer surface of top portion 20 which fits into a corresponding female feature on an accessory such as a divot repairer or ball pick-up. With the key in a locked orientation engagement of the male and female features further secures the accessory in position on the device.

Figure 3:
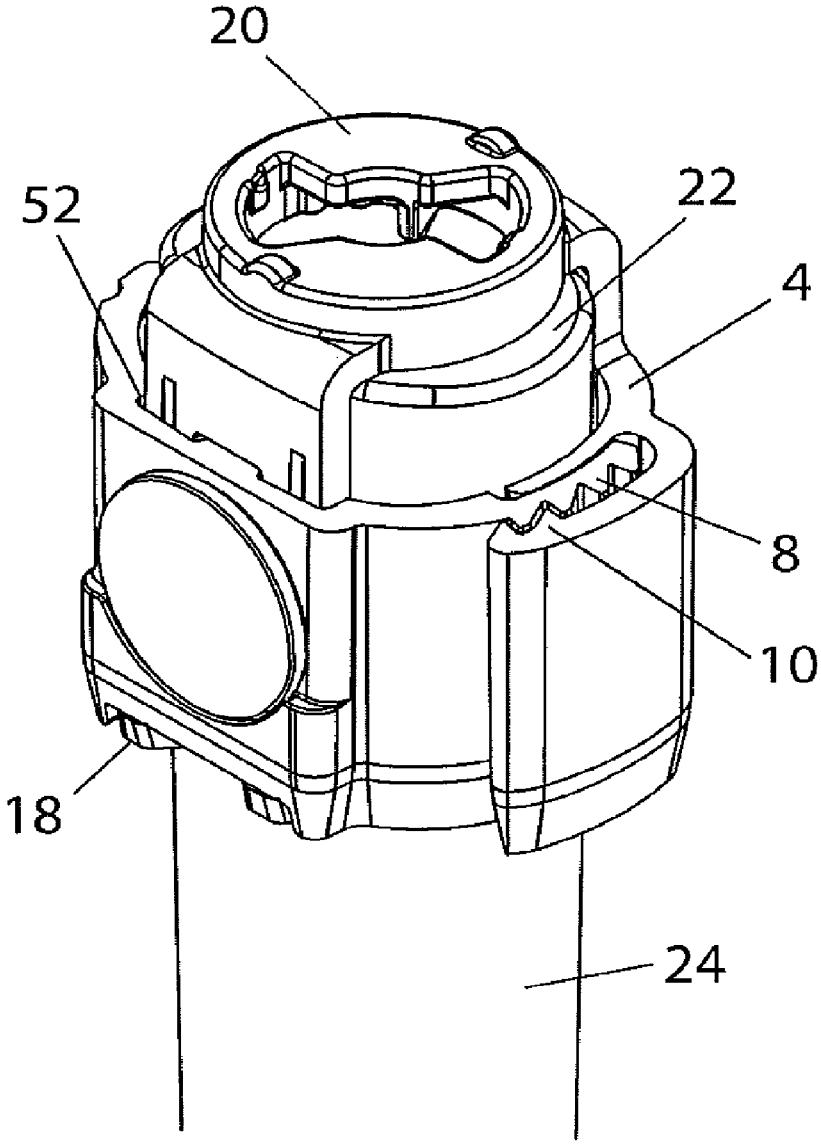
Figure 3:
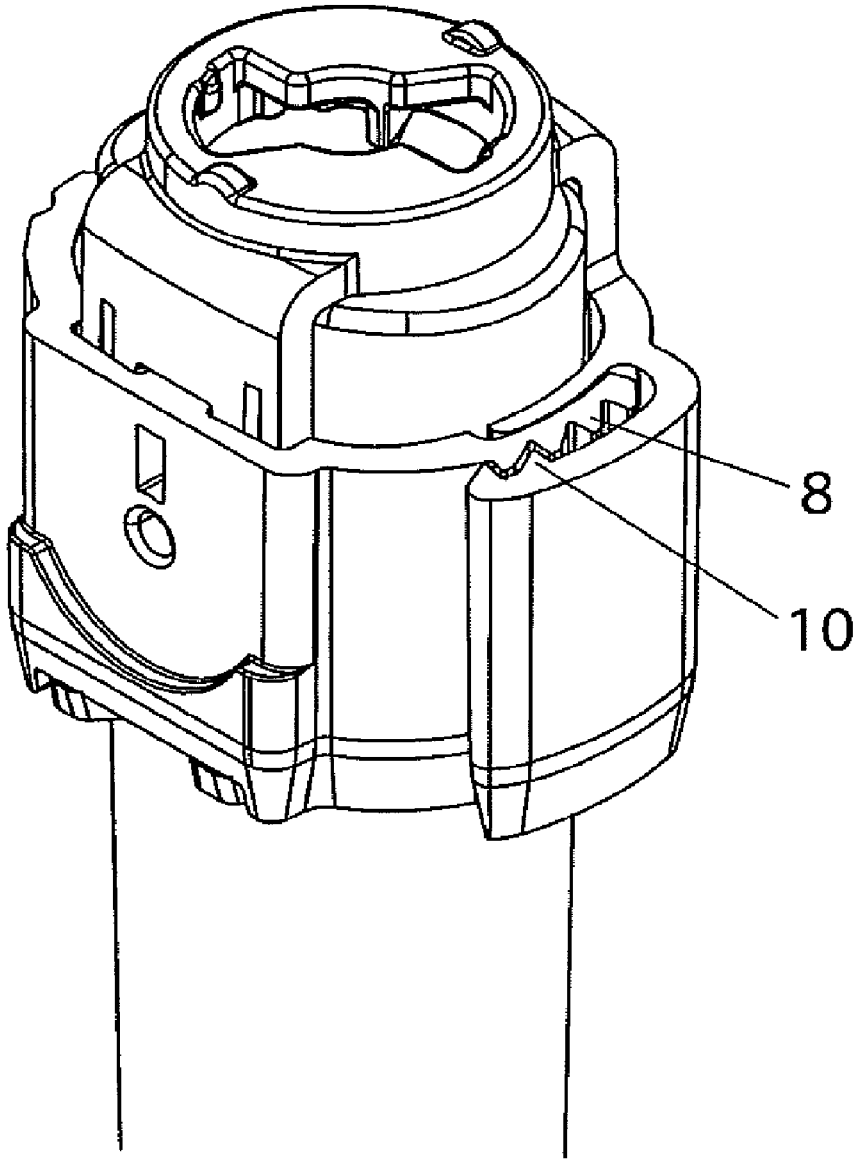

FIG. 3 shows the device of FIGS. 1 and 2 fixed to a handle end 22 of a golf club, such as a putter, 24. As can be seen curved wall 4 is placed around the putter end 22 and is held in this fixed position by engagement of the co-operative engagement means 8, 10. With the curved wall 4 encircling such a putter, and with the end portion 2 of the putter abutting the top portion 20 of the device, the curved inner wall 16 and member 18 are urged against an external surface of the putter holding the device firmly in place. In particular member 18, positioned within indentation 52, is displaced from its rest position to press against the putter end 22 and inner wall 4. In the embodiment wherein member 18 comprises two legs 56, each leg is displaced both in a direction perpendicular to and also parallel to a surface of the putter end 22 and wall 4. By squeezing the wall 4 such that the fingers 8, 10 move past each other until they lock and securely fix the device on the putter handle, the device can accommodate all variations in sizes of putters or putter handles.

FIG. 3(*b*) shows a further embodiment in which further fingers 10 are provided as engagement means for fixing the device to a putter handle.

Figure 4:
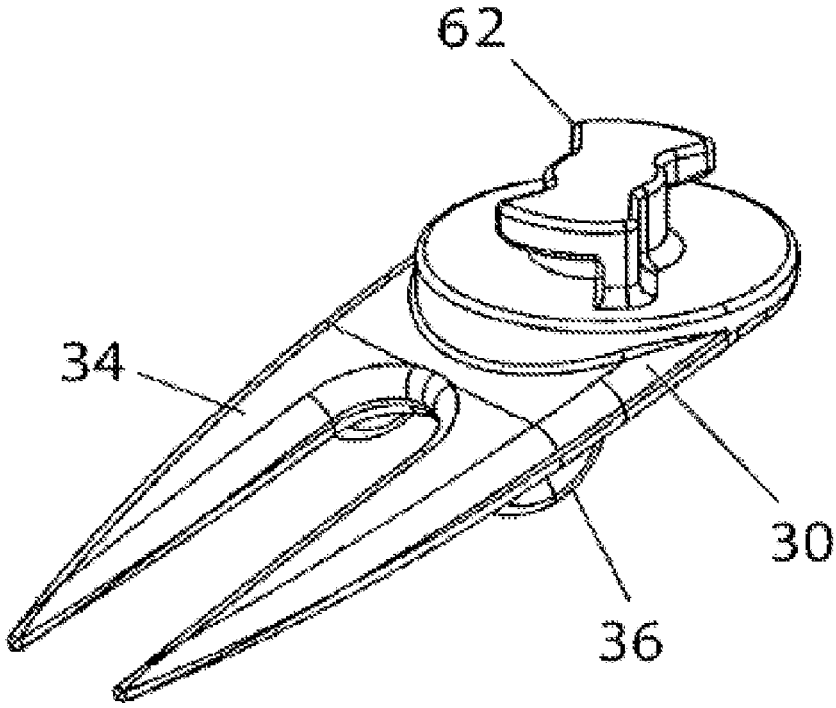
FIG. 4 shows a perspective view of an accessory for use with the device of FIGS. 1 and 2.

One accessory for use with the device is shown in FIG. 4, and comprises a divot repairer 30. The divot repairer 30 includes at a first end key 62 and at a position remote the key two fingers 34. In the embodiment of FIG. 4 the divot repairer includes semicircular ridges 36, however in a further embodiment shown in FIG. 6(*a*) the divot repairer includes ribs 38.

Figure 5:
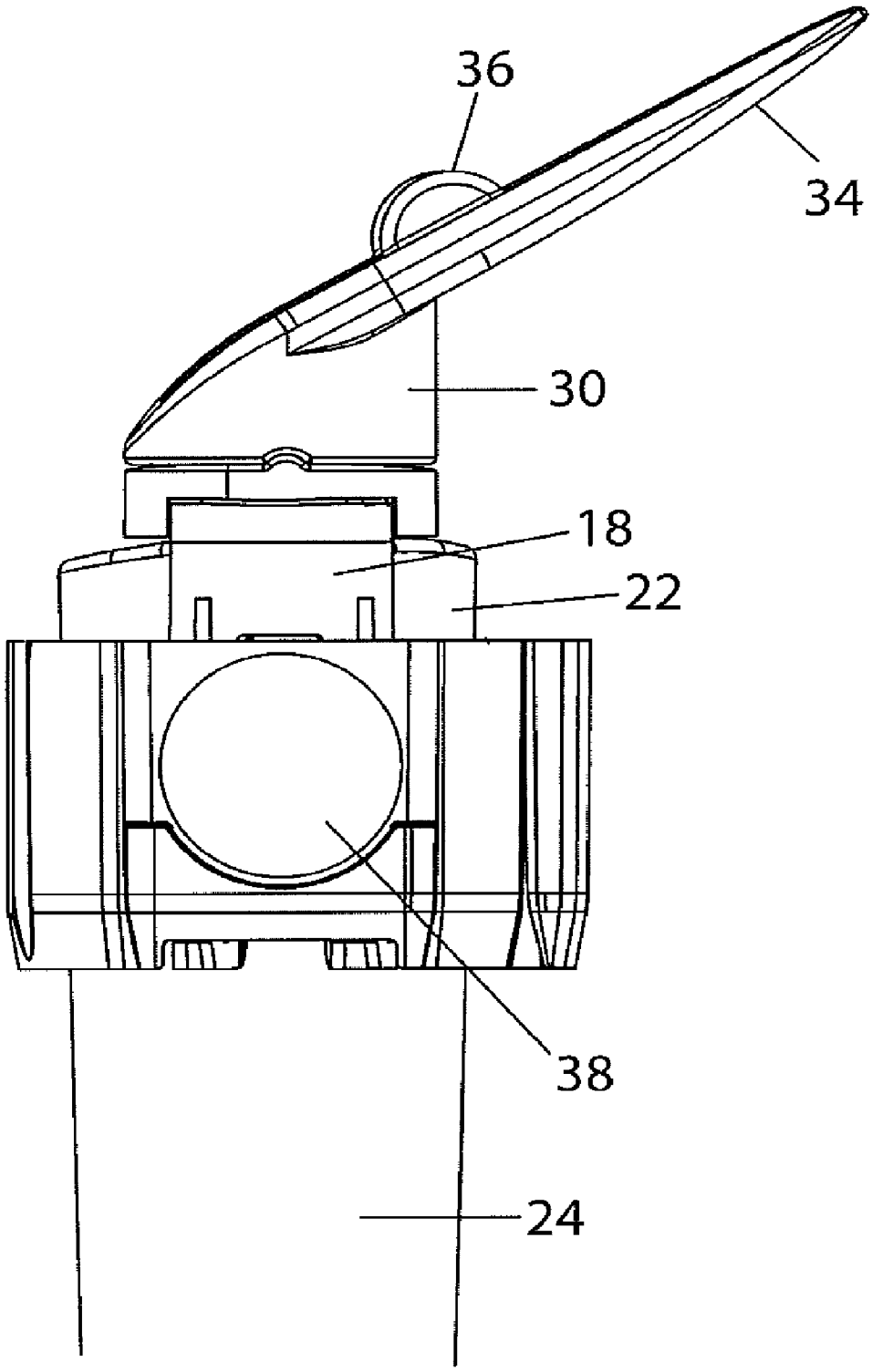
FIG. 5 shows the accessory of FIG. 4 attached to the device on a golf club, such as a putter, FIGS. 6(*a*) and (*b*) show a perspective view of the accessory of FIG. 4 attached to a device mounted on a golf club, such as a putter.

FIG. 5 shows the device mounted on a handle end of a putter, as seen in FIG. 3, with the key 62 of the divot repair accessory 30 locked in place within lock 26. As can be seen fingers 34 extend away from the putter at an angle to the plane of the top of the putter. The angle may be between 5 to 50 degrees to the plane of the top of the putter, i.e. to the horizontal plane which includes the plane of the top of the putter, or may be in the range of 20 to 45 degrees to the plane of the top of the putter, or may be within 30 to 40 degrees to the plane of the top of the putter.

Figure 6:
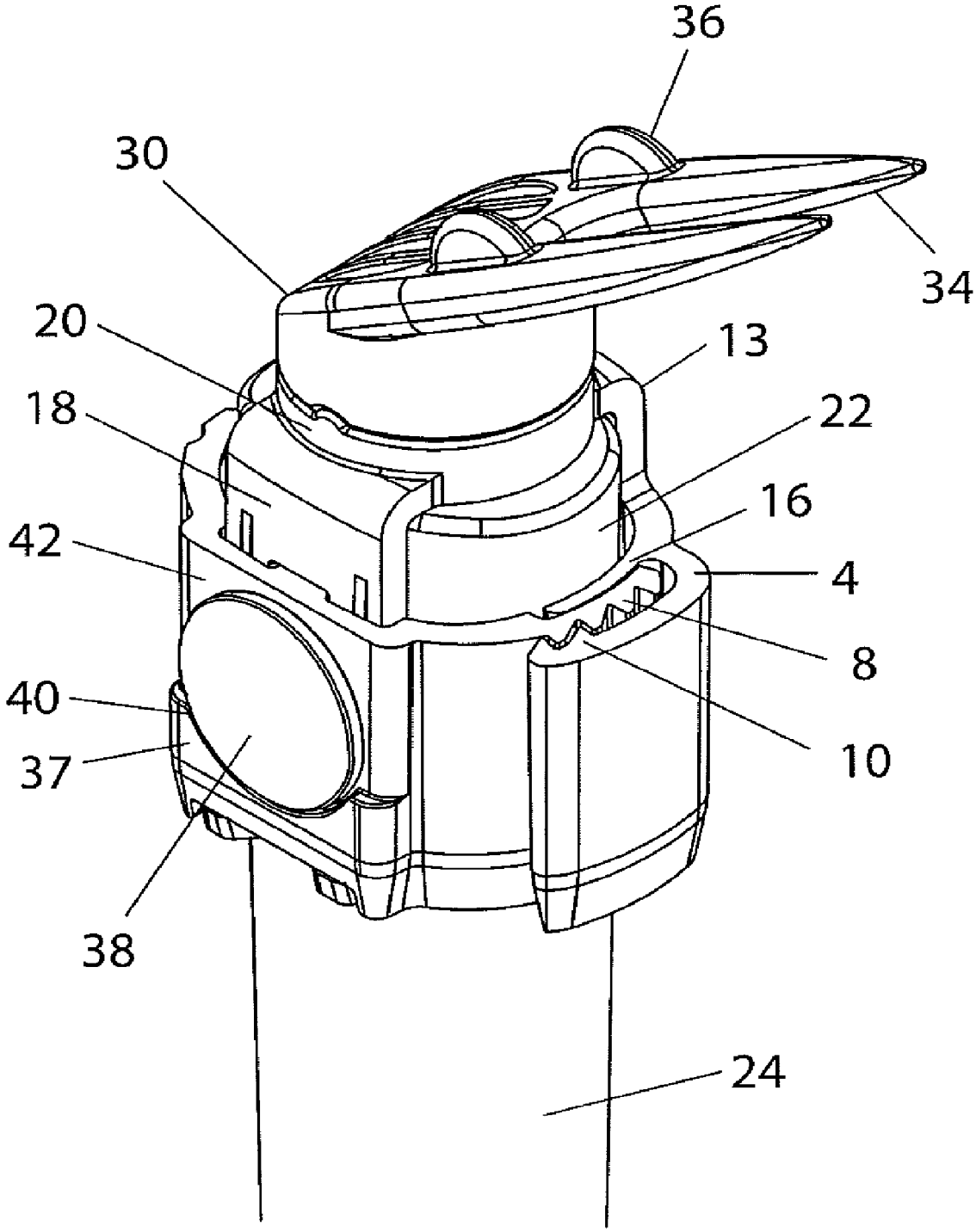
Figure 6:
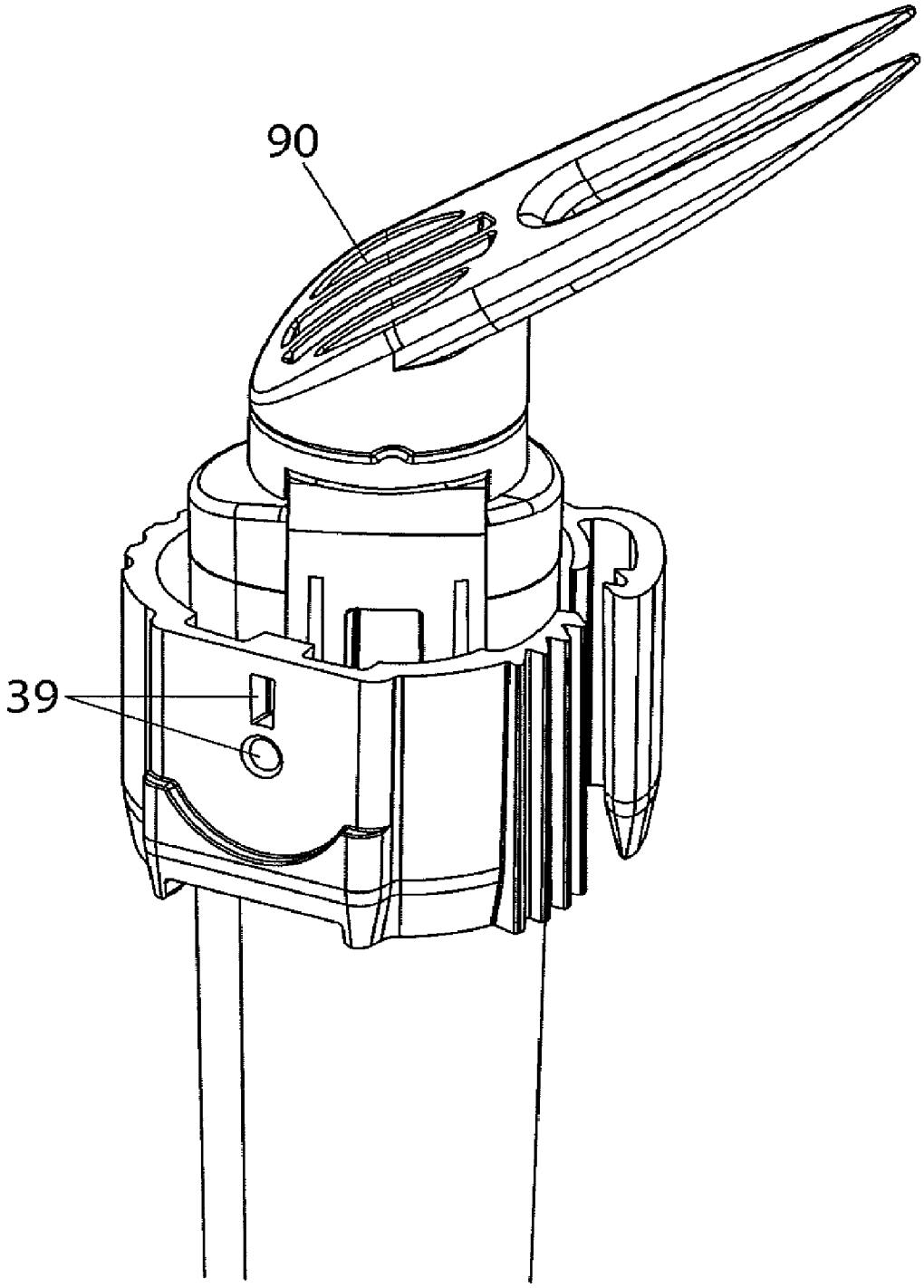

FIG. 6 (*a*) shows the device of FIG. 1 mounted on a golf club such as a putter with the divot repairer affixed to the device. FIG. 6 (*a*) also shows an external surface 37 of the device adjacent indentation 52 upon which can be mounted a further accessory 38. As can also be seen from FIG. 6(*b*) external surface 37 includes a channel 40 surrounding a planar surface 42, the planar surface 42 including means (39) to engage with a corresponding means (not shown) on further accessory 38. The engagement means may comprise a spike (not shown) on the accessory 38 co-operating with an opening (39) on the planar surface 42, or other suitable engagement means. Accessory 38 might comprise, for example, a device to mark the position of a ball, or some other device.

Figure 7:
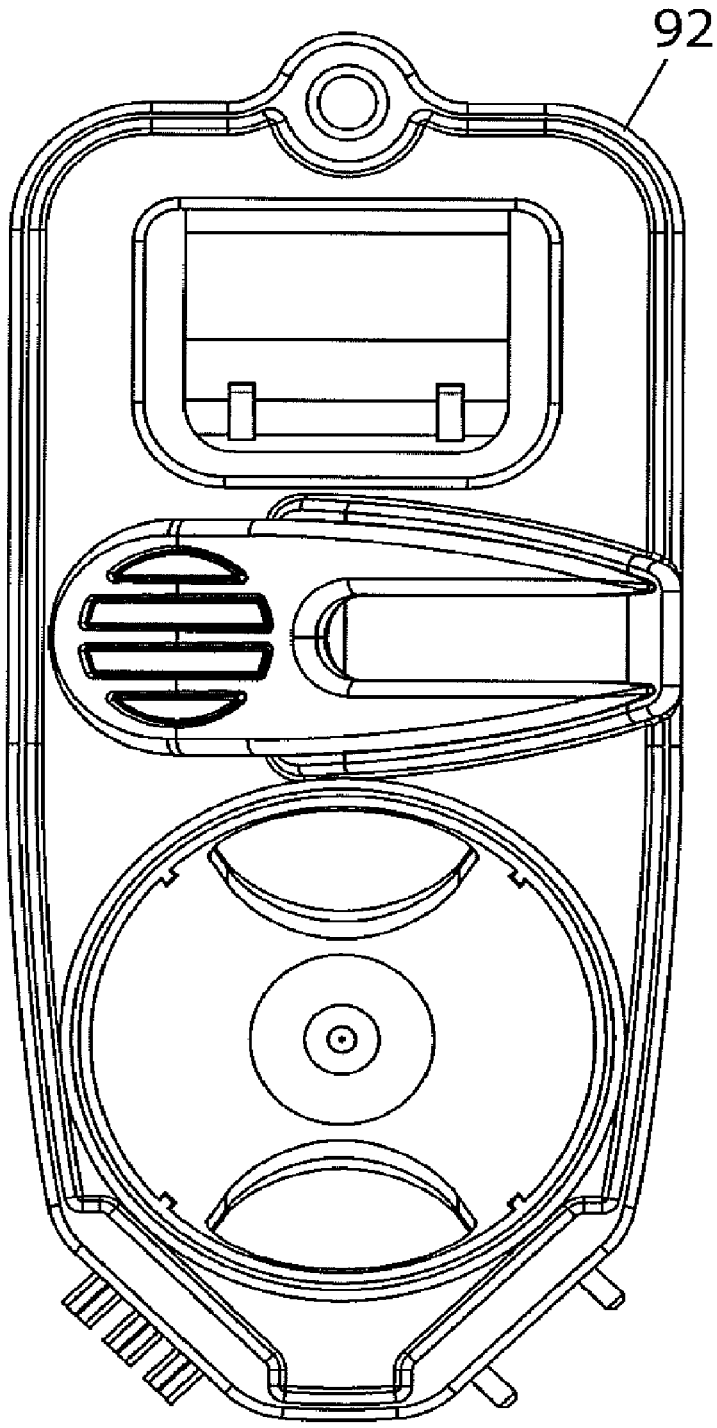
FIG. 7 shows an accessory clip for storing accessories.

The device of FIG. 1 may be stored in a golf bag or other carrier and when needed may be attached to the end of a putter. Alternatively the device may be retained on the putter as a permanent attachment as desired. To further assist with storage an accessory clip 92 is also provided as shown in FIG. 7, the accessory clip provided to accommodate for example divot repairer 30, gripper 64, and further accessory 38, and may be attached to an internal feature of a golf bag or possibly on a golfer's belt.

As part of a game, a golfer may often need to reach down to the ground, for example to pick up a golf ball or repair the surface of the green, and this can prove uncomfortable for the elderly or disabled. Should such an action be necessary, the golfer may retrieve the device from his golf bag and taking hold of the handle of a golf club such as a putter may place the device thereon. Once placed upon the handle, the device should then be pushed onto the putter handle until the top portion 20 is resting against an end thereof, at which time the wall 4 may then be gently squeezed until the engagement means 8, 10 engage together to hold the device on the handle. With the device mounted thus on the putter handle, interior walls 16, 18, are squeezed between the external surface of the putter handle and the interior of the wall 4, thereby restricting the space of the cavity in which the handle is held. The more firmly the ends 12, 14 of the walls are squeezed together the better the grip of the device onto the handle, until there is no more flexibility in the device and the grip maximized.

With the device attached to the handle of a golf club such as for example a putter, the golfer may then retrieve a desired accessory from the accessory clip 92, for example a divot repairer, affix it to the handle and, while keeping hold of the putter, manoeuvre the putter such that the handle with the device and attached accessory is adjacent the ground. The golfer may thereby repair the grass without straining the back or knees. Other accessories may be attached to the device by means of the opening 26 and key 32 which for example may assist in the retrieval and retention of a ball, such as a golf ball, or other useful functions.

The invention is not restricted to the details of the foregoing embodiment. For example the wall may not be a single wall but may comprise two walls, hinged together. The engagement means provided to engage the two ends 12, 14 may be suitable means other than those shown in the Figures. The engagement means provided on the top portion may be engagement means other than the opening and key shown in the Figures. The rim 54 of member 18 or legs 56 may be tapered or may be omitted entirely.

The invention claimed is:

1. A device for a game, the device attachable to, and usable to removably fix an accessory to, a playing means, the device including a substantially annular gripping portion to grip on an end of the playing means and surrounding an integral inner member, said gripping portion including a first and a second end, the arrangement being such that with said first and second ends urged towards one another the gripping portion squeezes the inner member against the playing means to more securely grip the playing means, the device further comprising:

receiving means to receive an accessory; and locking means to unlock-ably lock said received accessory in position;

wherein said receiving means comprises an opening for engagement with a portion of an accessory, and wherein said opening includes a shelf portion extending into said opening for secure engagement with a corresponding portion of an accessory.

2. The device as claimed in claim 1 wherein said first end includes means co-operatively engageable with means on said second end, and wherein said gripping portion is held in an annular configuration by said co-operative engagement means which, when squeezed against a resilient force keeping the ends apart, engage to hold the ends together.

3. The device of claim 2 wherein said co-operative engagement means comprise teeth.

4. The device of claim 1 wherein said annular gripping portion comprises a curved wall, and wherein the device further comprises a further wall portion on an interior surface of said curved wall adjacent a first end of said wall.

5. The device of claim 4 further comprising a top portion extending from said annular gripping portion to form a partial closure for one end of a cavity formed by said annular gripping portion such that with a golf club shaft entered into said cavity an end of said shaft abuts an internal surface of said closure.

6. The device of claim 5 wherein said top portion includes a member extending into said cavity.

7. The device of claim 6 wherein said member is said inner member.

8. The device of claim 6 wherein said member comprises a single leg.

9. The device of claim 8 wherein said curved wall includes an indented portion for receiving said leg.

10. The device of claim 6 wherein said member comprises two legs.

11. The device of claim 1 wherein said opening includes a rim.

12. The device of claim 11 wherein said rim includes a scalloped edge.

13. A golf club with the device of claim 1 attached.

14. A device for a game, the device attachable to a playing means and including a substantially annular gripping portion surrounding an inner member, said gripping portion including a first and a second end, the arrangement being such that with said first and second ends urged towards one another the gripping portion squeezes the inner member to more securely grip the playing means, a top portion attached to said annular gripping portion and extending over one end of a cavity formed by a curved wall, wherein said top portion includes a member extending into said cavity, wherein said member comprises two legs, and wherein said curved wall includes an indented portion for receiving said legs.

15. A device for a game, the device attachable to a playing means and including a substantially annular gripping portion surrounding an inner member, said gripping portion including a first and a second end, the arrangement being such that with said first and second ends urged towards one another the gripping portion squeezes the inner member to more securely grip the playing means, a top portion attached to said annular gripping portion and extending over one end of a cavity formed by a curved wall, wherein said receiving means comprises an opening in said top portion, wherein said opening includes a rim, and wherein said rim includes a scalloped edge.

* * * * *